US007108050B2

(12) United States Patent
Reichle et al.

(10) Patent No.: US 7,108,050 B2
(45) Date of Patent: Sep. 19, 2006

(54) HEAT TRANSFER UNIT, ESPECIALLY FOR A MOTOR VEHICLE

(75) Inventors: Frank Reichle, Korntal-Münchingen (DE); Michael Spieth, Gomaringen (DE)

(73) Assignee: BEHR GmbH & Co., Stuttgart (DE)

( * ) Notice: Subject to any disclaimer, the term of this patent is extended or adjusted under 35 U.S.C. 154(b) by 69 days.

(21) Appl. No.: 10/488,259

(22) PCT Filed: Apr. 7, 2003

(86) PCT No.: PCT/EP03/03600

§ 371 (c)(1),
(2), (4) Date: Mar. 12, 2004

(87) PCT Pub. No.: WO03/085348

PCT Pub. Date: Oct. 16, 2003

(65) Prior Publication Data

US 2004/0251002 A1 Dec. 16, 2004

(30) Foreign Application Priority Data

Apr. 9, 2002 (DE) ..... 102 15 624
Nov. 25, 2002 (DE) ..... 102 55 011

(51) Int. Cl.
*F28F 7/00* (2006.01)

(52) U.S. Cl. ..... 165/81; 165/153; 165/149

(58) Field of Classification Search ..... 165/81, 165/148, 149, 152, 153
See application file for complete search history.

(56) References Cited

U.S. PATENT DOCUMENTS 3,939,908 A * 2/1976 Chartet ..... 165/149
5,671,806 A 9/1997 Schmalzried
5,954,123 A * 9/1999 Richardson ..... 165/81
5,992,514 A * 11/1999 Sugimoto et al. ..... 165/149
6,328,098 B1 * 12/2001 Kodumudi et al. ..... 165/149
6,412,547 B1 * 7/2002 Siler ..... 165/81
2002/0023735 A1 2/2002 Uchikawa et al.
2002/0029869 A1 3/2002 Kodumudi et al.
2002/0084064 A1 * 7/2002 Rhodes et al. ..... 165/149

FOREIGN PATENT DOCUMENTS

| | | |
|---|---|---|
| DE | 1 199 071 | 8/1965 |
| DE | 27 40 937 C2 | 3/1979 |
| DE | 39 37 463 A1 | 5/1990 |
| DE | 195 19 633 A1 | 12/1996 |
| DE | 197 53 408 A1 | 6/1999 |
| EP | 0 623 205 B1 | 7/1996 |
| EP | 0 748 995 A2 | 12/1996 |
| GB | 1 592 125 | 7/1981 |

OTHER PUBLICATIONS

Patent Abstracts of Japan, vol. 1996, No. 11, Nov. 29, 1996, JP 8-178556, Jul. 12, 1996.

* cited by examiner

*Primary Examiner*—Teresa J. Walberg
(74) *Attorney, Agent, or Firm*—Foley & Lardner LLP

(57) ABSTRACT

Disclosed is a heat transfer unit including at least two heat transfer elements, especially for a motor vehicle. The unit includes a plurality of tubes and corrugated ribs, two side parts which enclose the monoblock on the opposite sides thereof, whereby at least one side part comprises at least one expansion section.

13 Claims, 2 Drawing Sheets

HEAT TRANSFER UNIT, ESPECIALLY FOR A MOTOR VEHICLE

The invention relates to a heat transfer unit with at least two heat transfer elements, especially for a motor vehicle, according to the preamble of claim 1.

A heat transfer unit, especially in a monoblock version, consists of at least two heat transfer elements in a structural unit, with the result that construction space and production costs are saved, as compared with a configuration with separate heat transfer elements, and of at least two side parts which frame the heat transfer unit. In such heat transfer units, as a result of temperature changes and temporarily different temperature levels associated with these in the heat transfer elements, mechanical stresses occur between the individual heat transfer elements on account of their different thermal expansion, and these stresses may lead to leaks. Furthermore, in the event of temperature changes, the stresses associated with these between the heat transfer elements and the side parts subject the ends of tubes in the heat transfer unit to load, and this may also lead to leaks here.

For this reason, DE 197 53 408 A1 proposes a heat transfer element having a rib/tube block, the side parts of which are provided, outside a net structure, with expansion joints. In this case, at least one expansion portion is arranged level with the net structure of the rib/tube block. The expansion portion may in this case be designed as a fold-like expansion joint or as expansion beads with clearance portions, tensioning straps for mounting and soldering the rib/tube block being led through the clearance portions, in order to hold the unit together.

The object of the invention is to improve a heat transfer element of this type.

This object is achieved by means of a heat transfer element with the features of claim 1.

According to the invention, a heat transfer unit consists of at least two heat transfer elements and has a plurality of tubes and corrugated ribs connected to one another in the manner of a net structure. Furthermore, at least two side parts framing the heat transfer unit are provided, at least one side part having at least one expansion portion. Preferably, the at least one expansion portion runs essentially in a longitudinal direction of the side part. An expansion portion of this type allows transverse decoupling in the side part [lacuna] mechanical decoupling of two heat transfer elements. In spite of the decoupling, a heat transfer unit according to the invention has a sufficiently high stability of the side parts for transport and manufacture.

Preferably, in addition to the expansion portion mentioned above, the at least one side part has provided in it a further expansion portion which runs in the transverse direction of the side part and allows longitudinal decoupling for the protection of the tube ends. An arrangement of this type makes it possible for the two heat transfer elements to be decoupled completely with respect to one another.

Preferably, the side part has provided in it at least one perforation which is arranged between two expansion portions.

Preferably, the expansion portion is formed by one or more fold-like beads. If a plurality of beads are provided, these are preferably separated from one another by perforations. In this case, preferably, the beads or perforations are in alignment with one another. This results in a better soldering of the two nets as a result of the hinge action of the side parts, since the different set behavior of the two nets is compensated on account of the unequal tube geometries.

Preferably, the perforations are designed to be wider than the beads. In this case, the width of the perforations in the longitudinal direction is preferably between five and ten times as great as the width of the beads in the longitudinal direction of the side surface.

Preferably, the beads are designed in such a way that they are formed outwardly. This produces a relatively planar surface on the inside of the side parts.

According to a preferred embodiment, a marginal region of the side part is bent at approximately 90° along the longitudinal edge of the side part, and the expansion portion for longitudinal decoupling is formed by two fold-like beads. In this case, the beads are preferably designed in such a way that they have a mirror-symmetrical design, being formed toward one another.

Preferably, the expansion regions are arranged in a region which is arranged on the outside of the side parts. This produces a relatively planar surface on the inside of the side parts.

The invention is explained in more detail below by means of an exemplary embodiment, with reference to the drawing in which.

Figure 1:
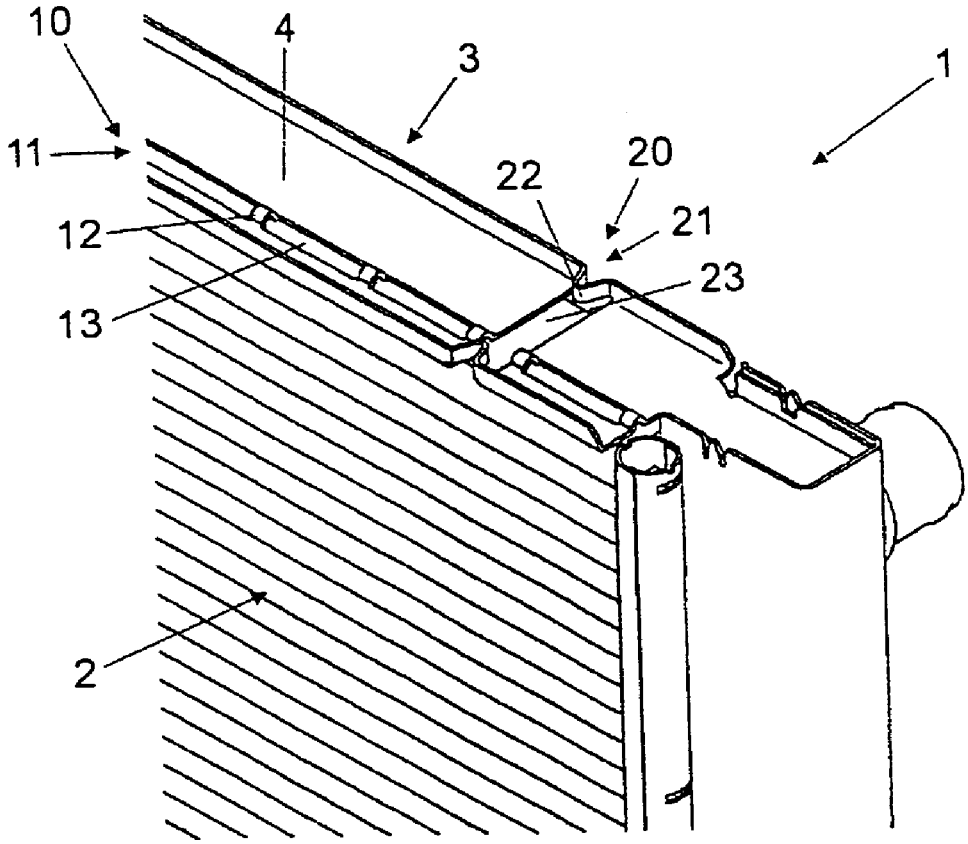
FIG. 1 shows a partial perspective illustration of a monoblock.

A heat transfer unit 1 according to the invention, in the form of a soldered all-aluminum monoblock, has a flat-tube condenser 2, a coolant cooler 3, which comprise a plurality of flat tubes and corrugated ribs connected to one another in the manner of a net structure, and two side parts 4 located opposite one another.

The side parts 4 have transverse decoupling 10 in the form of an expansion portion 11 for decoupling the flat-tube condenser 2 and coolant cooler 3 and longitudinal decoupling 20 for the protection of the flat-tube ends, in the form of an expansion portion 21.

The expansion portion 11 for decoupling the flat-tube condenser 2 and coolant cooler 3 is formed by a plurality of fold-like beads 12 which, spaced apart from one another by perforations 13, are arranged in alignment in the longitudinal direction of the side parts 4. In this case, the expansion portion 11 is arranged nearer to the flat-tube condenser 2 than to the coolant cooler 3. The width of the perforations 13 in the longitudinal direction of the side parts 4 is greater than the width of the fold-like beads 12 in the longitudinal direction of the side parts 4, the width of the perforations 13 being approximately six times as great as the width of the fold-like beads 12. According to the present exemplary embodiment, the fold-like beads 12 are bent outwardly, that is to say away from the flat-tube condenser 2 and from the coolant cooler 3 (see FIG. 1).

Figure 2:
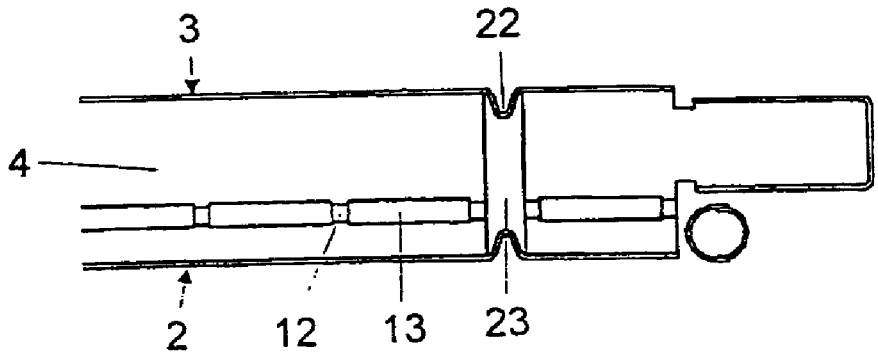
FIG. 2 shows a top view of the monoblock of FIG. 1.

The expansion portion 21 for longitudinal decoupling 20 for the protection of the flat-tube ends is formed by part of a marginal region of the side parts 4 which is bent outwardly at approximately 90° and which is provided with a fold-like bead 22. The side parts 4 have a slot-like perforation 23 which runs in the transverse direction and extends from one marginal region to the opposite marginal region. The fold-like beads 22 are designed in such a way that they point toward one another (see FIG. 2).

The beads 12 and 22 lie on the side of the side parts 4 which is arranged on the outside, so that an essentially planar surface is provided on the inside.

Figure 3:
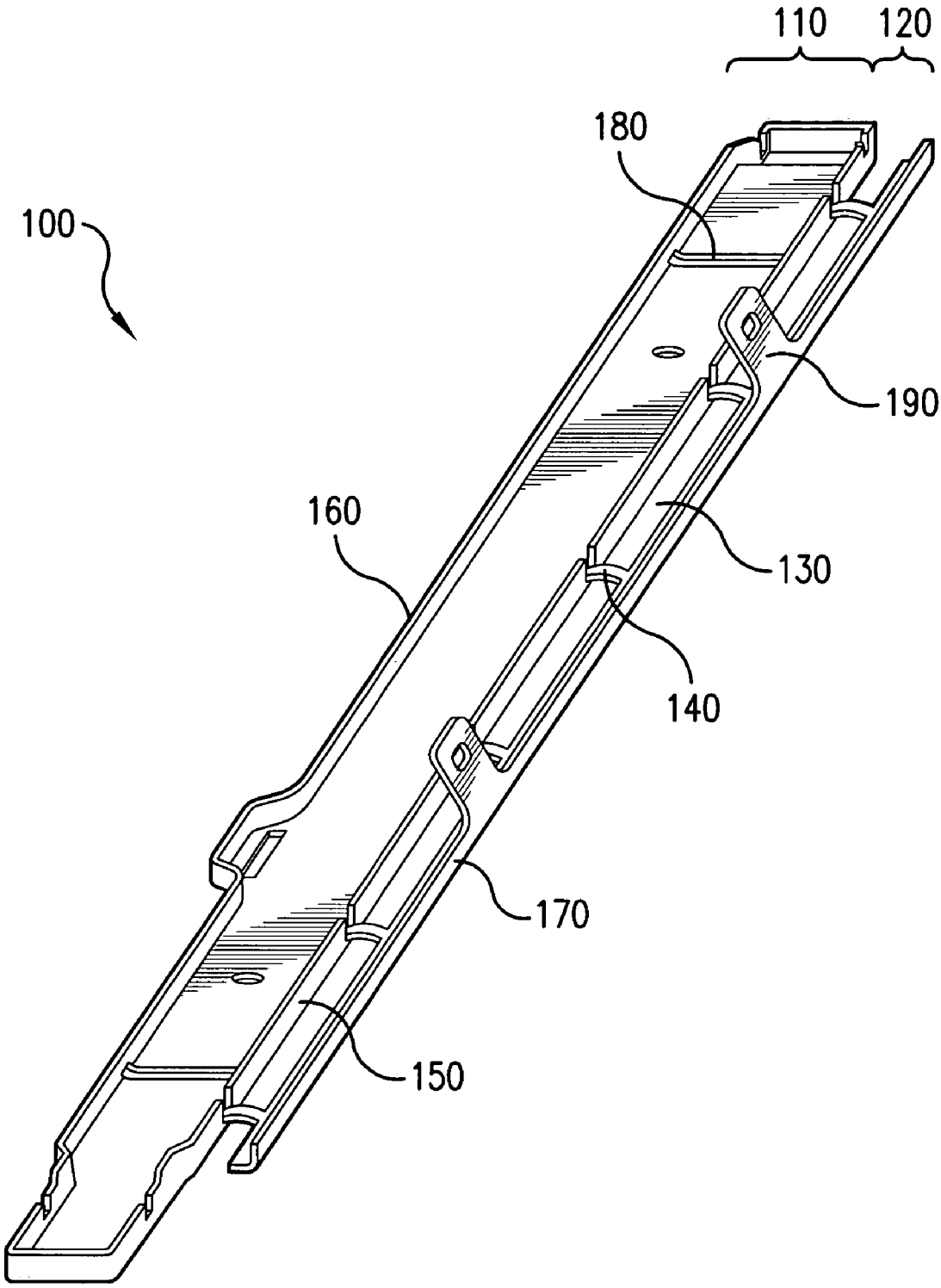
FIG. 3 shows a perspective illustration of a side part.

FIG. 3 illustrates a perspective view as a further exemplary embodiment of a side part 100 for a heat transfer unit, not shown, with two different heat transfer elements. The side part 100 likewise has transverse decoupling between a region 110 assigned to a first heat transfer element and a region 120 assigned to a second heat transfer element. The transverse decoupling is implemented by means of perforations 130, so that the regions 110 and 120 are connected to one another solely by means of webs 140, the webs 140 being configured in a bent shape for improved decoupling. In order to increase the bending rigidity of the side part 100, margins 150 in the perforations 130 are set up, so that the action of the set-up side part edges 160 and 170 is reinforced.

For longitudinal decoupling, the side part 100 has transversely running perforations 180 in addition to the perforations 130. Holding devices 190 serve for mounting the entire heat transfer unit in a motor vehicle and, for simplification, are produced in one piece with the side part 100.

The side parts 4 have transverse decoupling 10 in the form of an expansion portion 11 for decoupling the flat-tube condenser 2 and coolant cooler 3 and longitudinal decoupling 20 for the protection of the flat-tube ends, in the form of an expansion portion 21.

The expansion portion 11 for decoupling the flat-tube condenser 2 and coolant cooler 3 is formed by a plurality of fold-like beads 12 which, spaced apart from one another by perforations 13, are arranged in alignment in the longitudinal direction of the side parts 4. In this case, the expansion portion 11 is arranged nearer to the flat-tube condenser 2 than to the coolant cooler 3. The width of the perforations 13 in the longitudinal direction of the side parts 4 is greater than the width of the fold-like beads 12 in the longitudinal direction of the side parts 4, the width of the perforations 13 being approximately six times as great as the width of the fold-like beads 12. According to the present exemplary embodiment, the fold-like beads 12 are bent outwardly, that is to say away from the flat-tube condenser 2 and from the coolant cooler 3 (see FIG. 1).

LIST OF REFERENCE SYMBOLS

1 Heat transfer unit
2 Flat-tube condenser
3 Coolant cooler
4 Side part
10 Transverse decoupling
11 Expansion portion
12 Bead
13 Perforation
20 Longitudinal decoupling
21 Expansion portion
22 Bead
23 Perforation
100 Side part
110 First heat transfer element region
120 Second heat transfer element region
130 Perforation for transverse decoupling
140 Web
150 Set-up
160 Set-up
170 Set-up
180 Perforation for longitudinal decoupling
190 Holding device

The invention claimed is:

1. A motor vehicle heat transfer unit with at least two heat transfer elements, comprising a plurality of tubes and corrugated ribs, and at least two side parts which frame the heat transfer unit on opposite sides, at least one side part having at least one first expansion portion, wherein the first expansion portion runs essentially in the longitudinal direction of the side part and at least one second expansion portion, wherein the second expansion portion runs essentially in the transverse direction of the side part.

2. The heat transfer unit as claimed in claim 1, wherein at least one perforation is provided in the side part.

3. The heat transfer unit as claimed in claim 1, wherein at least one first expansion portion is formed by one or more fold-like beads.

4. The heat transfer unit as claimed in claim 3, wherein the beads are separated from one another by perforations.

5. The heat transfer unit as claimed in claim 4, wherein the beads are in alignment with one another.

6. The heat transfer unit as claimed in claim 4, wherein the perforations are wider than the beads.

7. The heat transfer unit as claimed in claim 3, wherein the beads are formed outwardly.

8. The heat transfer unit as claimed in claim 3, wherein the beads are formed inwardly.

9. The heat transfer unit as claimed in claim 1, wherein a marginal region of the side part is bent at approximately 90° along a longitudinal edge of the side part, and the expansion portion is formed by two fold-like beads.

10. The heat transfer unit as claimed in claim 9, wherein the beads are formed toward one another.

11. The heat transfer unit as claimed in claim 1, wherein the expansion regions are arranged in a region which is arranged on the outside of the side parts.

12. The heat transfer unit as claimed in claim 1, wherein the heat transfer unit comprises two second expansion portions, wherein the second expansion portions each run essentially in the transverse direction of the side part.

13. The heat transfer unit as claimed in claim 6, wherein the perforations are about 6 times as wide as the beads.

* * * * *